US008105056B2

(12) United States Patent
Chan

(10) Patent No.: US 8,105,056 B2
(45) Date of Patent: Jan. 31, 2012

(54) AERATING BAG

(76) Inventor: Shu-Chen Chan, Fengyuan (TW)

( * ) Notice: Subject to any disclaimer, the term of this patent is extended or adjusted under 35 U.S.C. 154(b) by 359 days.

(21) Appl. No.: 12/536,651

(22) Filed: Aug. 6, 2009

(65) Prior Publication Data

US 2011/0030819 A1 Feb. 10, 2011

(51) Int. Cl.

| | |
|---|---|
| ***F04B 45/06*** | (2006.01) |
| ***A61B 5/02*** | (2006.01) |
| ***F16K 31/44*** | (2006.01) |
| ***F16K 15/14*** | (2006.01) |

(52) U.S. Cl. ..... 417/478; 417/441; 251/273; 137/848; 600/490

(58) Field of Classification Search ..... 417/478, 417/441, 296, 300; 137/848, 853; 251/273; 600/490, 498

See application file for complete search history.

(56) References Cited

U.S. PATENT DOCUMENTS

| | | | | |
|---|---|---|---|---|
| 2,245,097 | A * | 6/1941 | Tobler | 251/340 |
| 3,103,341 | A * | 9/1963 | Moran | 251/115 |
| 3,906,939 | A * | 9/1975 | Aronson | 600/493 |
| 4,072,171 | A * | 2/1978 | Nakazawa | 137/599.18 |
| 4,139,000 | A * | 2/1979 | Peeler | 600/490 |
| 4,146,018 | A * | 3/1979 | Aldridge et al. | 600/498 |
| 4,744,391 | A * | 5/1988 | Lardner | 137/877 |
| 5,556,258 | A * | 9/1996 | Lange et al. | 417/63 |

* cited by examiner

*Primary Examiner* — Charles Freay

(74) *Attorney, Agent, or Firm* — Alan Kamrath; Kamrath IP Lawfirm, PA

(57) ABSTRACT

An aerating bag has a body, a connector, a check valve and an intake valve. The body has a connecting tube, a mounting tube and a chamber. The chamber communicates with the connecting tube and the mounting tube. The connector is detachably connected to the body and has a connecting pipe, an inserting pipe, a mounting recess, a release pipe and a cover. The release pipe is formed on and protrudes from the connector and communicates with the connecting pipe and the inserting pipe. The cover is mounted on the release pipe. The check valve mounted in the mounting recess and has an open end, a closed end and a slit. The slit is formed longitudinally in the check valve near the closed end and communicates with a clearance between the connecting pipe and the check valve. The intake valve is detachably mounted in the mounting tube of the body.

13 Claims, 7 Drawing Sheets

AERATING BAG

BACKGROUND OF THE INVENTION

1. Field of the Invention

The present invention relates to an aerating bag, and more particularly relates to an aerating bag that can be operated easily and provide an anti-backflow effect.

2. Description of Related Art

A conventional aerating bag has a body, a connector and an intake valve. The connector is connected to the body and is used to insert into an object and has a release pipe. The release pipe is formed on the connector and is used to let air discharge out of the body. The intake valve is connected to the body and is used to let air flow into the chamber of the body.

Although the conventional aerating bag can provide an air inflation effect, and can leak air out of the conventional aerating bag by the release pipe, but the components of the release pipe may losing. Furthermore, when the conventional aerating bag fills air in the body via the intake valve, the air that flows into the object may be flow back the body and this will decrease the air inflation efficiency of the conventional aerating bag.

Therefore, the present invention provides an aerating bag to mitigate or obviate the aforementioned problems.

SUMMARY OF THE INVENTION

The main objective of the present invention is to provide an aerating bag that can be operated easily and provide an anti-backflow effect.

The aerating bag in accordance with the present invention has a body, a connector, a check valve and an intake valve. The body has a connecting tube, a mounting tube and a chamber. The chamber communicates with the connecting tube and the mounting tube. The connector is detachably connected to the body and has a connecting pipe, an inserting pipe, a mounting recess, a release pipe and a cover. The connecting pipe is mounted in the connecting tube of the body. The mounting recess is axially formed in the connecting pipe and communicates with the inserting pipe. The release pipe is formed on and protrudes from the connector and communicates with the connecting pipe and the inserting pipe. The cover is mounted on the release pipe. The check valve is detachably mounted in the mounting recess of the connector and has an open end, a closed end and a slit. The slit is axially formed on the check valve near the closed end and communicates with a clearance between the connecting pipe of the connector and the check valve. The intake valve is detachably mounted in the mounting tube of the body.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
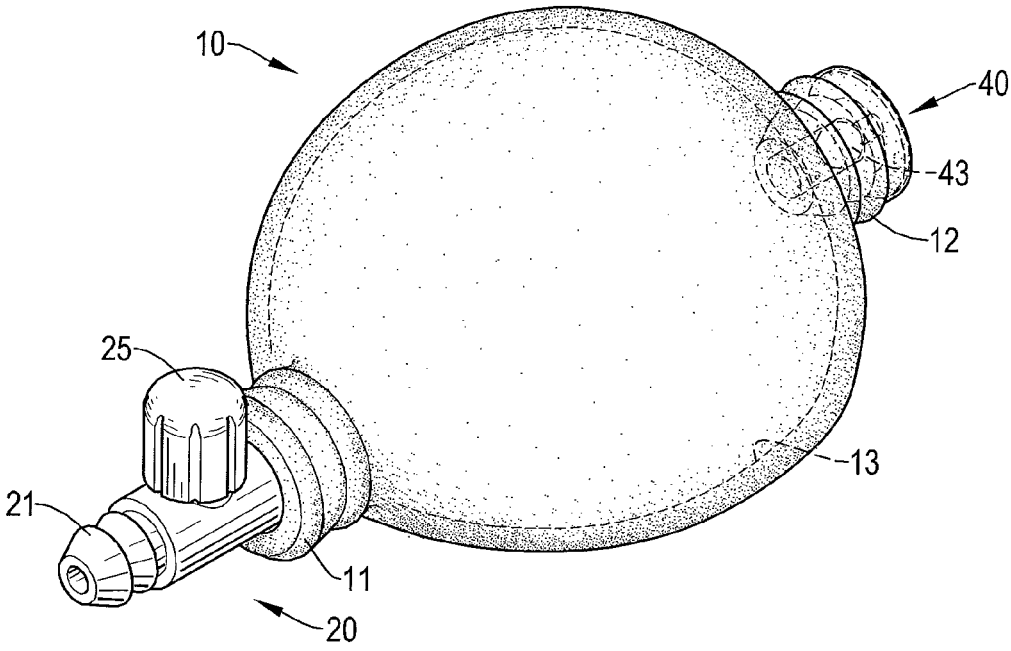
FIG. 1 is a perspective view of a first embodiment of an aerating bag in accordance with the present invention.
Figure 2:
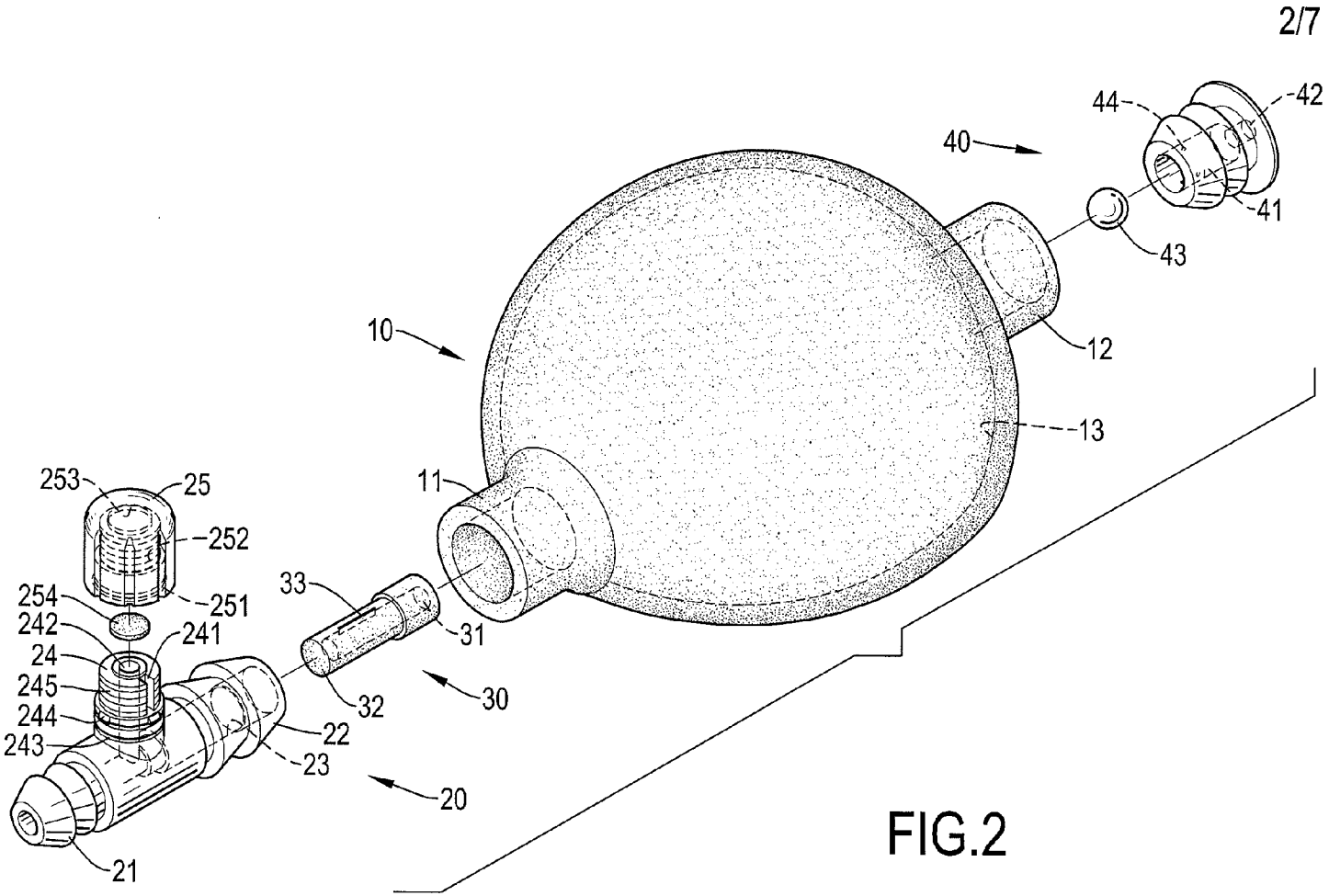
FIG. 2 is an exploded perspective of the aerating bag in FIG. 1.
Figure 3:
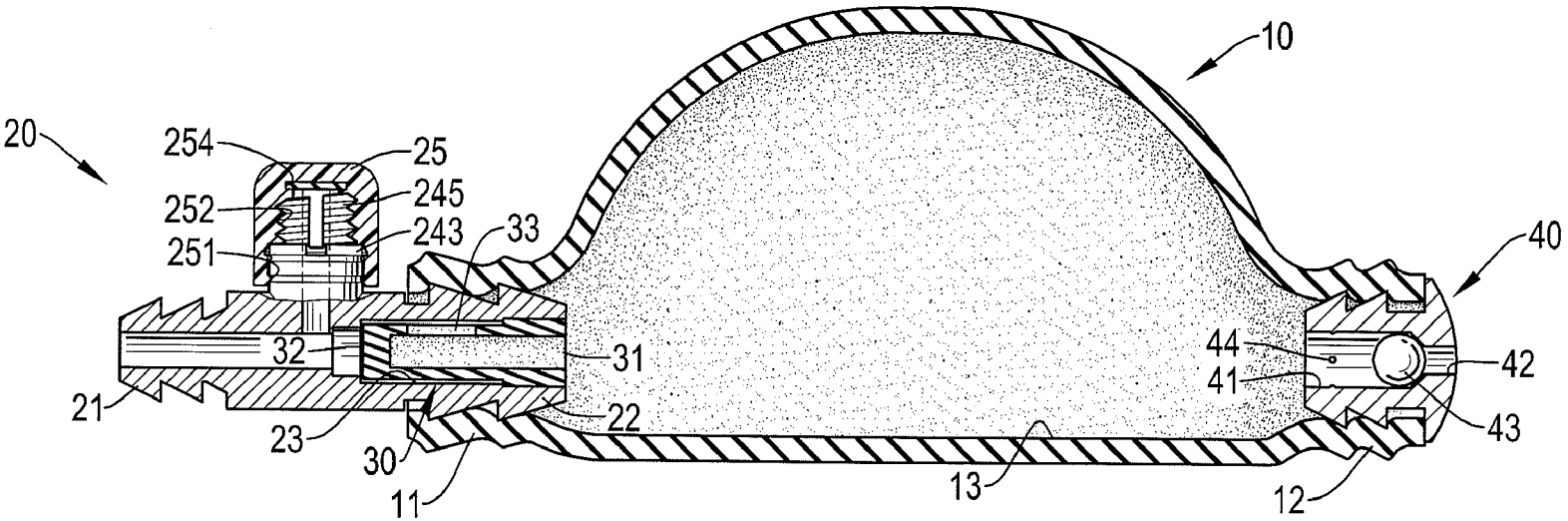
FIG. 3 is a side view in partial section of the aerating bag in FIG. 1.

With reference to FIGS. 1 to 3 and 7, an aerating bag in accordance with the present invention has a body (10), a connector (20), a check valve (30) and an intake valve (40).

The body (10) may be semispherical and compressible, and has a front side, a rear side, a connecting tube (11), a mounting tube (12) and a chamber (13). The connecting tube (11) is formed on and protrudes from the front side of the body (10). The mounting tube (12) is formed on and protrudes from the rear side of the body (10). The chamber (13) is formed in the body (10) and communicates with the connecting tube (11) and the mounting tube (12).

The connector (20) is detachably connected to the body (10) and has a proximal end, a distal end, an external surface, a connecting pipe (22), an inserting pipe (21), a mounting recess (23), a release pipe (24, 24A) and a cover (25, 25A). The connecting pipe (22) is formed on the proximal end of the connector (20), is mounted in the connecting tube (11) of the body (10) and communicates with the chamber (13) of the body (10). The inserting pipe (21) is formed on the distal end of the connector (20). The mounting recess (23) is axially formed in the connecting pipe (22), communicates with the connecting pipe (22) and has a diameter.

The release pipe (24, 24A) is hollow, is radially formed on and protrudes from the external surface of the connector (20), communicates with the connecting pipe (22) and the inserting pipe (21) and has a top, a bottom, an external surface, a release groove (241, 241A), a through hole (242, 242A), multiple holding grooves (243, 243A), multiple limiting blocks (244, 244A) and an outer thread (245). The release groove (241, 241A) is formed longitudinally in the external surface of the release pipe (24, 24A). The through hole (242, 242A) is formed in the top of the release pipe (24, 24A). The holding grooves (243, 243A) are formed around the external surface of the release pipe (24, 24A) near the bottom of the release pipe (24, 24A). The limiting blocks (244, 244A) are formed on and protrude from the external surface of the release pipe (24, 24A) at intervals above the holding grooves (243, 243A). The outer thread (245) is formed on the external surface of the release pipe (24) above the limiting blocks (244).

Figure 7:
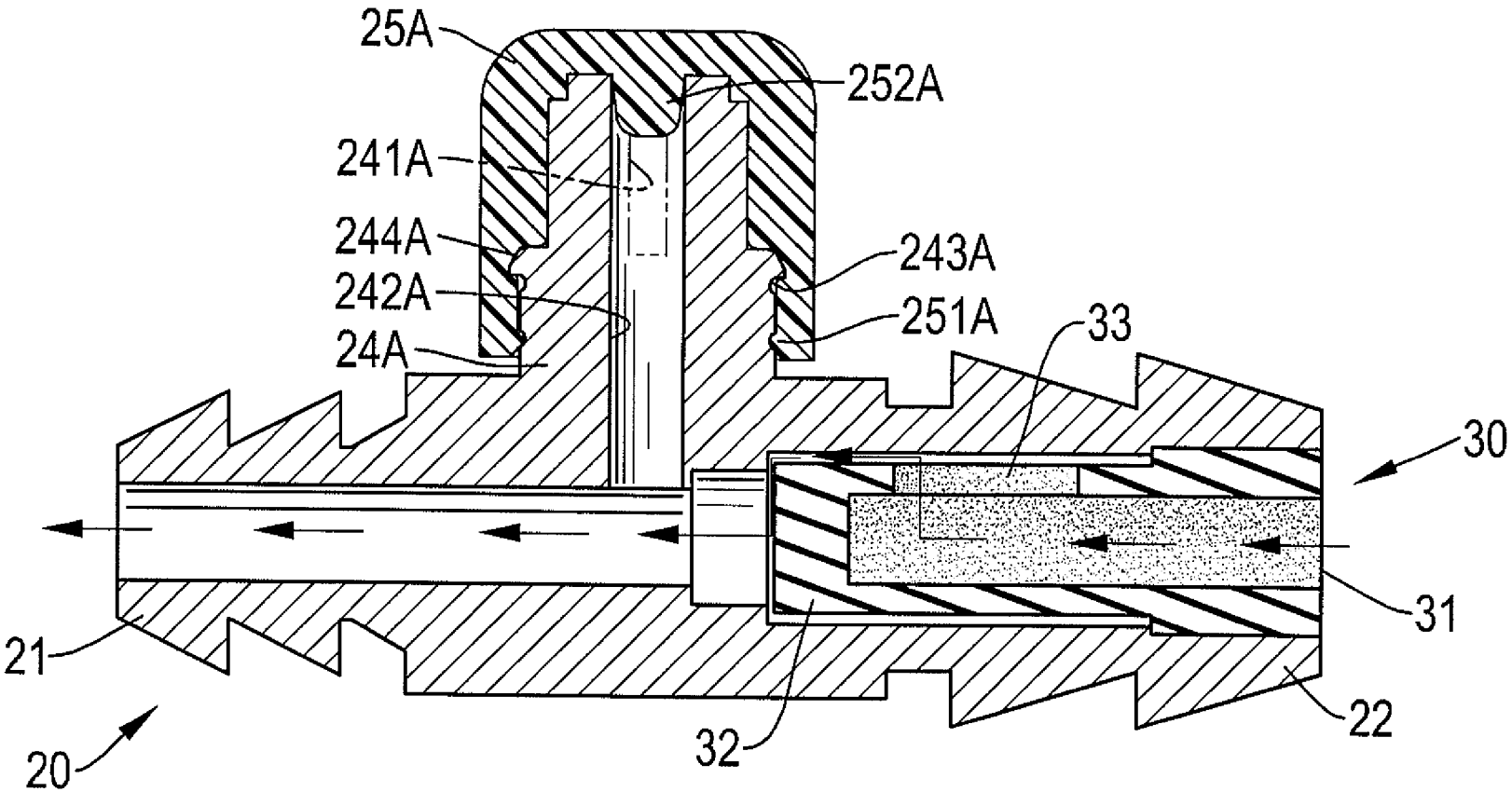
FIG. 7 is a cross sectional side view of a second embodiment of a connector of an aerating bag in accordance with the present invention.

The cover (25, 25A) is mounted on the release pipe (24, 24A) and has a closed top end, an open bottom end, an internal surface, an engaging ring (251, 251A), an inner thread (252) and an spacer recess (253), and may have a spacer (254) and a plunger (252A). The engaging ring (251, 251A) is formed on and protrudes from the internal surface of the cover (25, 25A) near the open bottom end and engages one of the holding grooves (243, 243A) of the release pipe (24, 24A). The inner thread (252) is formed on the internal surface of the cover (25) between the engaging ring (251) and the closed top end of the cover (25) and engages the outer thread (245) of the release pipe (24). The spacer recess (253) is formed on the internal surface of the cover (25) near the closed top end of the cover (25). The spacer (254) is mounted in the spacer recess (253) and is covered on the through hole (242) of the release pipe (24). With reference to FIG. 7, the plunger (252A) is axially formed on and protrudes from the closed top end of the cover (25A) and is mounted in the through hole (242A) of the release pipe (24A).

The check valve (30) may be a hollow pipe, is detachably mounted in the mounting recess (23) of the connector (20) and has a diameter, an external surface, an open end (31), a closed end (32) and a slit (33). The diameter of the check valve (30) is smaller than the diameter of the mounting recess (23) of the connector (20) to form a clearance between the connecting pipe (22) and the check valve (30). The open end (31) of the check valve (30) communicates with the chamber (13) of the body (10). The closed end (32) of the check valve (30) is mounted in the mounting recess (23) of the connector (20) near the release pipe (24, 24A). The slit (33) is formed longitudinally in the external surface of the check valve (30) near the closed end (32) to form two abutting surfaces and communicates with the clearance between the mounting recess (23) of the connector (20) and the check valve (30). The abutting surfaces of the slits (33) abut with each other generally to keep air from entering into the check valve (30).

The intake valve (40) is detachably mounted in the mounting tube (12) of the body (10) and has an inner end, an outer end, an internal surface, an inlet channel (41), an air hole (42), a valve ball (43) and multiple protrusions (44). The inner end of the intake valve (40) is mounted in the mounting tube (12) of the body (10). The inlet channel (41) is formed through the inner end of the intake valve (40) and communicates with the chamber (13) of the body (10). The air hole (42) is formed through the outer end of the intake valve (40), communicates with the inlet channel (41) and the chamber (13) of the body (10) and has a diameter. The valve ball (43) is movably mounted in the inlet channel (41) and has a diameter larger than the diameter of the air hole (42). The protrusions (44) are formed on and protrude from the internal surface of the intake valve (40) at intervals near the inner end of the intake valve (40) to prevent the valve ball (43) moving out of the inner end of the intake valve (40).

Figure 4:
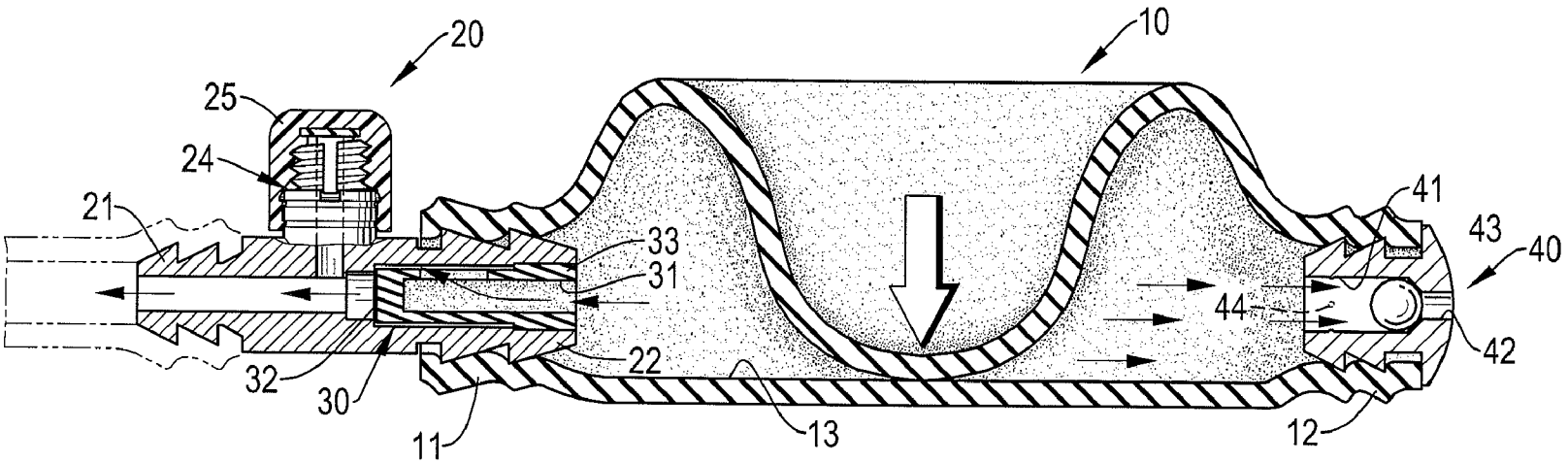
FIGS. 4 and 5 are operational side views in partial section of the aerating bag in FIG. 1.
Figure 5:
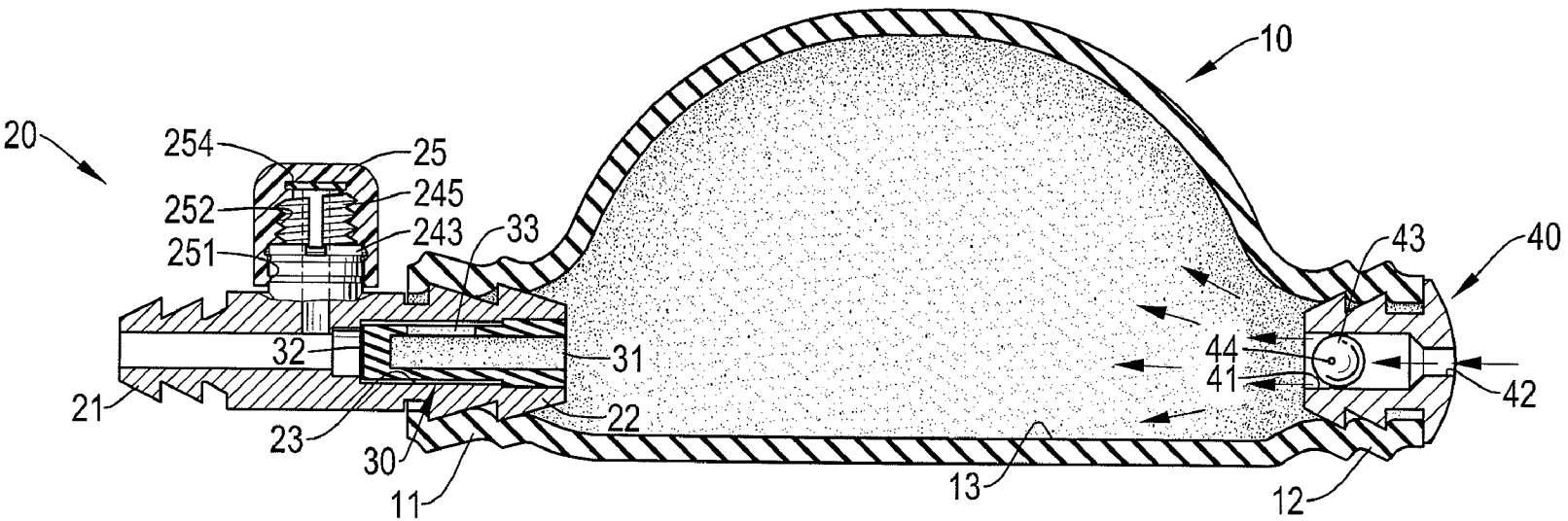

With reference to FIG. 4, when using the aerating bag in accordance with the present invention to fill air into an object, putting the inserting pipe (21) of the connector (20) into the object and pressing the body (10) to let the air in the chamber (13) flow into the open end (31) and the air will separate the abutting surfaces of the slit (33) to allow the air passing through the slit (33). Then, the air can flow into the clearance between the connecting pipe (22) of the connector (20) and the check valve (30) and the inserting pipe (21) of the connector (20) to the object. With reference to FIG. 5, when the body (10) is released, the valve ball (43) will move toward the inner end of the intake valve (40) along the inlet channel (41) to allow external air flowing into the chamber (13) of the body (10) via the air hole (41). Then, the body (10) can be pressed repeatedly to fill air into the object. At this time, the abutment of the abutting surfaces of the slits (33) can provide a checking effect to keep air from flowing backward into the body (10).

Figure 6A:
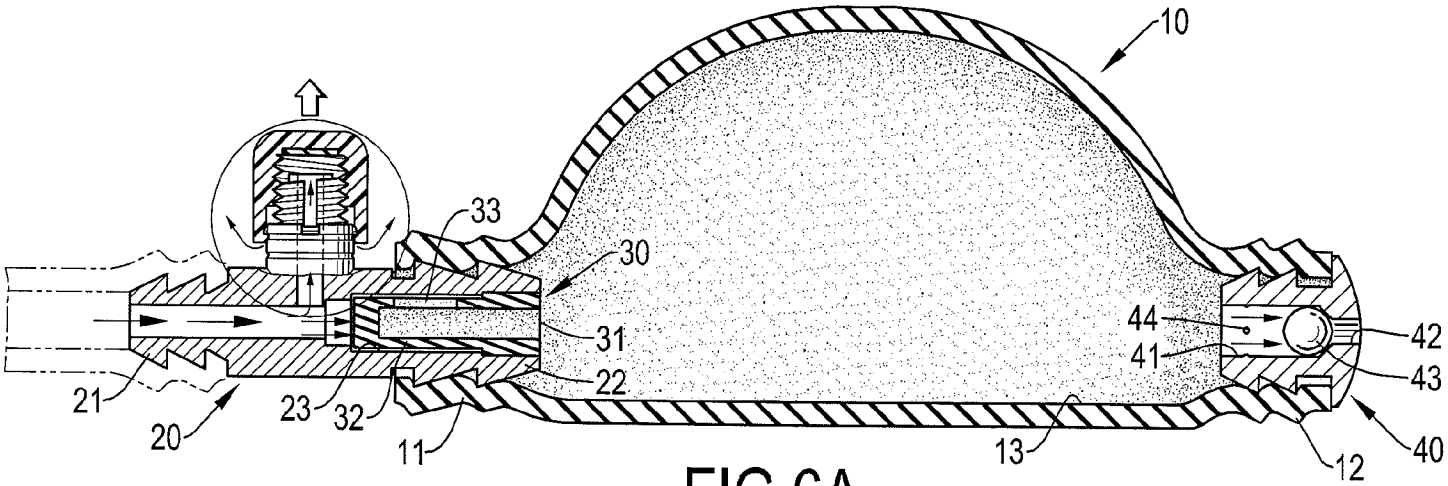
FIG. 6A is another operational side view in partial section of the aerating bag in FIG. 1.
Figure 6B:
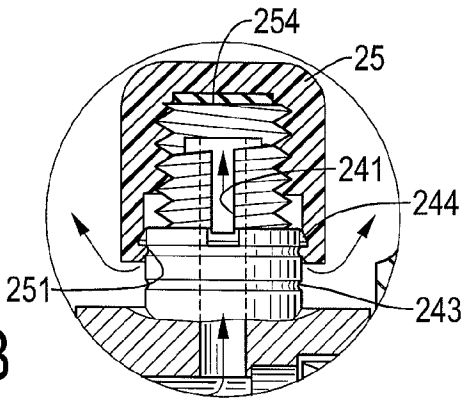
FIG. 6B is an enlarged side view in partial section of the aerating bag in FIG. 6A.

Furthermore, with reference to FIGS. 6A, 6B and 7, a user can release the superfluous air in the aerating bag or the object by rotating or moving the cover (25, 25A) relative to the release pipe (24, 24A) to make the spacer (254) or the plunger (252A) separating from the through hole (242, 242A) and the engaging ring (251, 251A) will separate from the holding grooves (243, 243A) and abuts with the limiting blocks (244, 244A) to prevent the cover (25, 25A) escaping from the release pipe (24, 24A). When the cover (25, 25A) separates from the release pipe (24, 24A), the superfluous air in the aerating bag or the object can be discharged out of the aerating bag or the object via the through hole (242, 242A) and the release groove (241, 241A). In addition, when the superfluous air is leaked out from the aerating bag or the object via the connecting pipe (22) or the inserting pipe (21), the superfluous air will provide a pressing effect on the external surface of the check valve (30) to make the abutting surfaces of the slit (33) become closer. Then, the superfluous air cannot backflow to the aerating bag and this can make the superfluous air only discharged out of the aerating bag or the object from the release groove (241, 241A), and the air in the object will not flow back to the aerating bag to provide a preferred air inflation efficiency.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An aerating bag having
- a body having
  - a front side;
  - a rear side;
  - a connecting tube formed on and protruding from the front side of the body;
  - a mounting tube formed on and protruding from the rear side of the body; and
  - a chamber formed in the body and communicating with the connecting tube and the mounting tube;
- a connector detachably connected to the body and having
  - a proximal end;
  - a distal end;
  - an external surface;
  - a connecting pipe formed on the proximal end of the connector, mounted in the connecting tube of the body and communicating with the chamber of the body;
  - an inserting pipe formed on the distal end of the connector;
  - a mounting recess axially formed in the connecting pipe, communicating with the connecting pipe and having a diameter;
  - a release pipe being hollow, radially formed on and protruding from the external surface of the connector, communicating with the connecting pipe and the inserting pipe and having
    - a top;
    - a bottom;
    - an external surface; and
    - a release groove longitudinally formed in the external surface of the release pipe; and
  - a cover mounted on the release pipe;
- a check valve detachably mounted in the mounting recess of the connector and having
  - a diameter being smaller than the diameter of the mounting recess of the connector to form a clearance between the connecting pipe and the check valve;
  - an external surface;
  - an open end communicating with the chamber of the body;
  - a closed end mounted in the mounting recess of the connector near the release pipe; and
  - a slit formed longitudinally in the external surface of the check valve near the closed end to form two abutting surfaces and communicating with the clearance between the connecting pipe of the connector and the check valve; and an intake valve detachably mounted in the mounting tube of the body.

2. The aerating bag as claimed in claim 1, wherein
the release pipe has
multiple holding grooves formed around the external surface of the release pipe near the bottom of the release pipe; and
multiple limiting blocks formed on and protruding from the external surface of the release pipe at intervals above the holding grooves; and
the cover has
a closed top end;
an open bottom end;
an internal surface; and
an engaging ring formed on and protruding from the internal surface of the cover near the open bottom end and engaging one of the holding grooves of the release pipe.

3. The aerating bag as claimed in claim 2, wherein
the release pipe has a through hole formed in the top of the release pipe; and
the cover has a plunger axially formed on and protruding from the closed top end of the cover and mounted in the through hole of the release pipe.

4. The aerating bag as claimed in claim 2, wherein
the release pipe has an outer thread formed on the external surface of the release pipe above the limiting blocks; and
the cover has an inner thread formed on the internal surface of the cover between the engaging ring and the closed top end of the cover and engaging the outer thread of the release pipe.

5. The aerating bag as claimed in claim 4, wherein
the release pipe has a through hole formed in the top of the release pipe; and
the cover has
a spacer recess formed on the internal surface of the cover near the closed top end of the cover; and
a spacer mounted in the spacer recess and covered on the through hole of the release pipe.

6. The aerating bag as claimed in claim 5, wherein the intake valve has
an inner end mounted in the mounting tube of the body;
an outer end;
an internal surface;
an inlet channel formed through the inner end of the intake valve and communicating with the chamber of the body;
an air hole formed through the outer end of the intake valve, communicating with the inlet channel and the chamber of the body and having a diameter;
a valve ball movably mounted in the inlet channel and having a diameter larger than the diameter of the air hole; and
multiple protrusions formed on and protruding from the internal surface of the intake valve at intervals near the inner end of the intake valve to prevent the valve ball moving out of the inner end of the intake valve.

7. The aerating bag as claimed in claim 6, wherein
the body is a semispherical and deformable bag; and
the check valve is a hollow pipe.

8. The aerating bag as claimed in claim 1, wherein
the release pipe has a through hole formed in the top of the release pipe; and
the cover has a plunger axially formed on and protruding from the closed top end of the cover and mounted in the through hole of the release pipe.

9. The aerating bag as claimed in claim 1, wherein
the release pipe has an outer thread formed on the external surface of the release pipe at the top of the release pipe; and
the cover has
a closed top end;
an internal surface; and
an inner thread formed on the internal surface of the cover between the engaging ring and the closed top end of the cover and engaging the outer thread of the release pipe.

10. The aerating bag as claimed in claim 1, wherein the intake valve has
an inner end mounted in the mounting tube of the body;
an outer end;
an internal surface;
an inlet channel formed through the inner end of the intake valve and communicating with the chamber of the body;
an air hole formed through the outer end of the intake valve, communicating with the inlet channel and the chamber of the body and having a diameter;
a valve ball movably mounted in the inlet channel and having a diameter larger than the diameter of the air hole; and
multiple protrusions formed on and protruding from the internal surface of the intake valve at intervals near the inner end of the intake valve to prevent the valve ball moving out of the inner end of the intake valve.

11. The aerating bag as claimed in claim 2, wherein the intake valve has
an inner end mounted in the mounting tube of the body;
an outer end;
an internal surface;
an inlet channel formed through the inner end of the intake valve and communicating with the chamber of the body;
an air hole formed through the outer end of the intake valve, communicating with the inlet channel and the chamber of the body and having a diameter;
a valve ball movably mounted in the inlet channel and having a diameter larger than the diameter of the air hole; and
multiple protrusions formed on and protruding from the internal surface of the intake valve at intervals near the inner end of the intake valve to prevent the valve ball moving out of the inner end of the intake valve.

12. The aerating bag as claimed in claim 3, wherein the intake valve has
an inner end mounted in the mounting tube of the body;
an outer end;
an internal surface;
an inlet channel formed through the inner end of the intake valve and communicating with the chamber of the body;
an air hole formed through the outer end of the intake valve, communicating with the inlet channel and the chamber of the body and having a diameter;
a valve ball movably mounted in the inlet channel and having a diameter larger than the diameter of the air hole; and
multiple protrusions formed on and protruding from the internal surface of the intake valve at intervals near the inner end of the intake valve to prevent the valve ball moving out of the inner end of the intake valve.

13. The aerating bag as claimed in claim 5, wherein the intake valve has
an inner end mounted in the mounting tube of the body;
an outer end;
an internal surface;

an inlet channel formed through the inner end of the intake valve and communicating with the chamber of the body;

an air hole formed through the outer end of the intake valve, communicating with the inlet channel and the chamber of the body and having a diameter;

a valve ball movably mounted in the inlet channel and having a diameter larger than the diameter of the air hole; and multiple protrusions formed on and protruding from the internal surface of the intake valve at intervals near the inner end of the intake valve to prevent the valve ball moving out of the inner end of the intake valve.

* * * * *